US005528824A

United States Patent [19]

Anthony et al.

[11] Patent Number: 5,528,824

[45] Date of Patent: Jun. 25, 1996

[54] METHOD OF FORMING A DOUBLE ARMOR CABLE WITH AUXILIARY LINE FOR AN ELECTRICAL SUBMERSIBLE PUMP

[75] Inventors: Roger B. Anthony, Claremore; David H. Neuroth, Tulsa, both of Okla.

[73] Assignee: Baker Hughes Incorporated, Houston, Tex.

[21] Appl. No.: 320,885

[22] Filed: Oct. 5, 1994

Related U.S. Application Data

[62] Division of Ser. No. 63,995, May 18, 1993, Pat. No. 5,384, 430.

[51] Int. Cl.[6] ..... H01B 13/22

[52] U.S. Cl. ..... 29/828; 29/890.144

[58] Field of Search ..... 29/828, 890.14, 29/890.144, 890.043, 517, 240; 174/103, 104, 115, 117 F

[56] References Cited

U.S. PATENT DOCUMENTS

| | | | |
|---|---|---|---|
| 3,272,912 | 9/1966 | Jachimowicz | 29/828 X |
| 4,282,398 | 8/1981 | Solomon | 174/104 X |
| 4,393,582 | 7/1983 | Arnold, Jr. et al. | 29/828 |
| 4,449,013 | 5/1984 | Garschick | 174/103 |
| 4,476,923 | 10/1984 | Walling | 417/404 X |
| 4,567,320 | 1/1986 | Neuroth et al. | 174/103 |
| 4,681,169 | 7/1987 | Brookbank, III | 174/103 X |
| 4,749,823 | 6/1988 | Ziemek et al. | 174/103 |

FOREIGN PATENT DOCUMENTS

| | | | |
|---|---|---|---|
| 475658 | 11/1952 | Italy | 29/828 |

*Primary Examiner*—Peter Vo
*Attorney, Agent, or Firm*—James E. Bradley

[57] ABSTRACT

A cable for a submersible pump has three insulated power conductors assembled in a flat configuration. The power conductors are wrapped with an inner armor such as a metal strip. An auxiliary line is placed alongside the inner armor and wrapped in an outer armor. The outer armor is also a metal strip.

18 Claims, 1 Drawing Sheet

METHOD OF FORMING A DOUBLE ARMOR CABLE WITH AUXILIARY LINE FOR AN ELECTRICAL SUBMERSIBLE PUMP

This application is a division of application Ser. No. 08/063,995, filed May 18, 1993 now U.S. Pat. No. 5,384, 430.

BACKGROUND OF THE INVENTION

1. Field of the invention

This invention relates in general to power cables for electrical submersible pumps, and in particular to a flat power cable having an auxiliary line for other uses.

2. Description of the Prior Art

In an electrical submersible pump installation for an oil well, the pump is driven by a downhole AC motor. The downhole pump assembly is suspended on the end of a string of tubing. A power cable extends from the surface alongside the tubing down to the motor.

Two types of power cable are in general use. Each type utilizes three insulated conductors for transmitting three-phase AC power. In one type, the insulated conductors are assembled in a cylindrical or round configuration, each 120 degrees apart from the other and located within an elastomeric jacket. An outer armor comprising a metal strip wraps helically around the round configuration of the jacket.

In the other type of cable, the conductors are assembled in a flat configuration. The conductors are located side by side, touching each other, and with their axes in a common plane. An armor comprising a metal strip wraps helically around the assembled insulated conductors. Flat cable is particularly used where there is insufficient clearance for round cable.

In some installations, an auxiliary line is useful. The auxiliary line might comprise a conductor or electrical wire for transmitting electrical or electronic signals to the surface from a pressure and/or temperature monitor at the downhole pump. Electrical wire could be used for other purposes, such as energizing solenoids for various functions. An auxiliary line could also be used for conveying fluids. It could be used to transmit a cooling fluid from the surface to the motor. It could be used to change the lubricating oil in the motor without pulling the assembly. Chemicals for inhibiting corrosion and scale could be pumped down the auxiliary line.

In the prior art, auxiliary lines have been separately deployed and strapped to the power cable at various points. This subjects the auxiliary line to being damaged during the installation and retrieval process. Separate deployment requires an additional reel, and possibly other surface equipment and personnel to run the line. Auxiliary lines have been proposed to be incorporated within the armor of round cable in U.S. Pat. No. 3,603,718, Gedenk, Sep. 7, 1971.

SUMMARY OF THE INVENTION

A flat power cable is provided for an electrical submersible pump assembly which has an auxiliary line. The insulated power conductors are assembled side by side, with a single plane passing through all of the axes. An inner armor comprising a metal strip is wrapped helically around the assembled power conductors. After the inner armor is wrapped, the auxiliary line is placed in contact with one curved side of the inner armor. An outer armor comprising a metal strip is wrapped helically around the auxiliary line and around the inner armor. This holds the auxiliary line in the flat or side by side position.

The auxiliary line preferably includes a metal tube. The tube may contain an electrical wire for transmitting signals. The metal tube may alternately be used for transmitting fluids. Additionally, two of the auxiliary lines may be employed, one on each curved side of the inner armor.

DETAILED DESCRIPTION OF THE INVENTION

Figure 1:
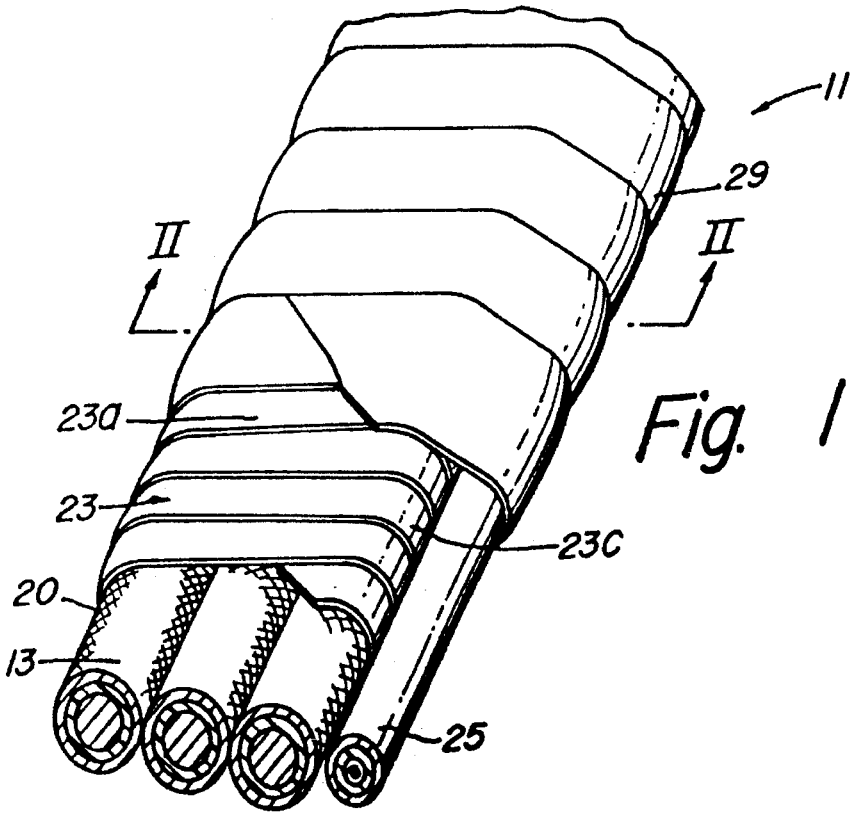
FIG. 1 is a perspective view showing a portion of a cable for an electrical submersible pump constructed in accordance with this invention.
Figure 2:
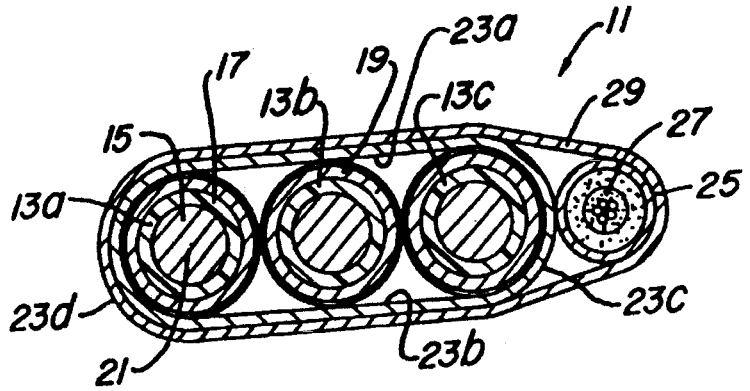
FIG. 2 is a sectional view of the cable of FIG. 1, taken along the line II—II of FIG. 1.

Referring to FIG. 1, power cable 11 has three power conductors 13. As shown in FIG. 2, power conductors 13 are assembled side by side, with power conductor 13*a* being located on one side of the configuration, power conductor 13*b* being located in the middle, and power conductor 13*c* being at the other side. Each power conductor 13 is conventional. It includes a copper central section 15. Copper section 15 is surrounded by an elastomeric insulation 17. The insulation 17 is encased within a sheath 19 that may be of lead. Sheath 19 is located within a fabric braid 20. Each power conductor 13 has an axis 21. The axes 21 are located in a single plane. The power conductors 13 touch each other at their sides, as shown in FIG. 2.

An inner armor 23 holds the conductors 13 in the flat or side by side configuration. Inner armor 23 comprises a metal strip that wraps helically around the assembled conductors 13*a*, 13*b* and 13*c*. The metal strip is overlapped at each wrap. As shown in FIGS. 1 and 2, once wrapped, inner armor 23 will have two parallel flat sides 23*a* and 23*b* joined by two curved sides 23*c* and 23*d*.

An auxiliary line 25 extends along one curved side 23*c* of inner armor 23. Auxiliary line 25 in FIG. 2 is shown to be a metal tube having an insulated electrical wire 27 located therein. The diameter of line 25 in the embodiment shown is less than the diameters of the power conductors 13, which equal each other. Electrical wire 27 is used for providing electrical or electronic signals, such as for a downhole pressure and temperature monitor. Wire 27 is formed conventionally with the metal tube of line 25 and is typically located within a mineral powder. Auxiliary line 25 is located in a side by side position. Auxiliary line 25 touches curved side 23*c*, and the axis of auxiliary line 25 is in the same plane as each power conductor axis 21.

An outer armor 29 holds auxiliary line 25 in the flat configuration. Outer armor 29 is also a metal strip wrapped helically. Outer armor 29 wraps around one side of auxiliary line 25, over flat side 23*a*, around curved side 23*d*, over flat side 23*b* and back around auxiliary line 25. The metal strip of outer armor 29 is overlapped.

As shown in FIG. 1, if desired, the width of each metal strip of outer armor 29 may be greater than the width of each metal strip of inner armor 23. For example, inner armor 23 may be approximately three-fourths inch wide and wrapped at the rate of 30–40 wraps per foot. Outer armor 29 may be one to one and one-half inches in width and wrapped 10–20 wraps per foot. Additionally, the outer armor 29 may be of thicker metal than the inner armor 23. The thickness and the width of the metal strip of inner armor 23 are limited so as to avoid crushing the power conductors 13 during the wrapping process. Once the inner armor 23 has been wrapped, however, the inner armor provides additional hoop strength for the power conductors 13. The greater strength allows the outer armor 29 to be of thicker metal and of wider strips, because the inner armor 23 will not be as susceptible to crushing as the individual power conductors 13 were when they were being wrapped with the inner armor 23. Additionally, the inner and outer armors 23, 29 may be of different metals. For example, the inner armor 23 could be of monel to avoid chemical attack. The outer armor 29 could be of galvanized steel for strength.

Figure 3:
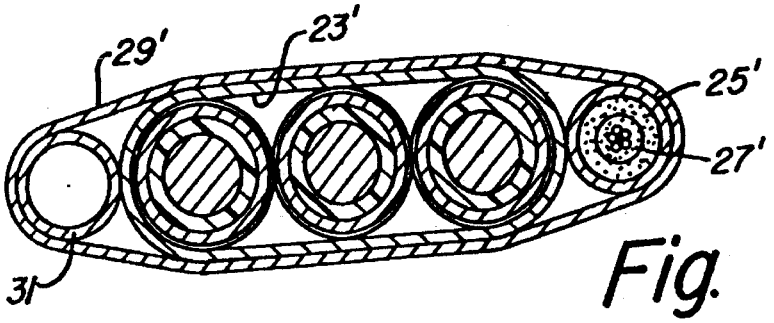
FIG. 3 is a sectional view of an alternate embodiment of a cable constructed in accordance with this invention.

The embodiment of FIG. 3 is the same as described above except that it has an additional auxiliary line 31 assembled within outer armor 29'. Auxiliary line 31 is located on a side opposite auxiliary tube line 25'. Outer armor 39' wraps completely around inner armor 23' and around the auxiliary lines 31' and 25'. In the embodiment shown, auxiliary tube line 31 is hollow for fluid transmission. It does not contain an electrical wire 27' as does auxiliary tube line 25'. Outer armor 29' wraps completely around inner armor 23' and around the auxiliary tube lines 31 and 25'.

In operation, the three power conductors 13 will be formed and wrapped with inner armor 23 conventionally. The auxiliary tube line 25 will be placed alongside and wrapped with outer armor 29. When the pump is installed in the well, the assembly will be placed alongside the tubing and strapped at various points in a conventional manner.

The invention has significant advantages. Locating the auxiliary tube line within an outer armor provides additional strength for the assembly. It avoids damage to the auxiliary line. It allows a flat configuration to remain. The double wrap of armor allows a greater width of metal strip for the outer armor and greater thickness for additional strength to the assembled cable. The double wrap of armor allows a different type of metal to be used between the inner and outer tubes for different purposes, to avoid chemical attack and to provide strength. The auxiliary tube can be broken away from the assembled cable at selected points along the length of the cable. The double wrap provides additional armoring and shielding for the electric wire.

While the invention has been shown in only two of its forms, it should be apparent to those skilled in the art that it is not so limited, but is susceptible to various changes without departing from the scope of the invention.

I claim:

1. A method of forming a cable for an electrical submersible pump, comprising:

placing three insulated power conductors in a side by side flat configuration, defining an assembly of power conductors with two outside conductors and an intermediate conductor; then wrapping a metal strip around the assembly of power conductors to hold the power conductors in the side by side flat configuration and to provide an inner armor which has two flat sides joined by two curved sides; then placing at least one auxiliary line in a side by side position in contact with one of the curved sides of the inner armor; and wrapping a metal strip helically around the auxiliary line and over the inner armor, thereby forming a cable for an electrical submersible pump, with the metal strip wrapped around the auxiliary line holding the auxiliary line in the side by side position and defining an outer armor.

2. The method according to claim 1, wherein:

the step of placing three insulated power conductors in a side by side flat configuration comprises providing each of the power conductors with the same outer diameter; and the step of placing at least one auxiliary line in a side by side position comprises providing the auxiliary line with an outer diameter that differs from the outer diameter of the power conductors.

3. The method according to claim 1, wherein:

the step of placing three insulated power conductor in a side by side flat configuration comprises providing each of the power conductors with the same outer diameter; and the step of placing at least one auxiliary line in a side by side position comprises providing the auxiliary line with an outer diameter that is less than the outer diameter of the power conductors.

4. The method according to claim 1, wherein:

the step of placing at least one auxiliary line in a side by side position comprises providing the auxiliary line with a hollow tubular interior for passing fluids.

5. The method according to claim 1, wherein:

the step of placing at least one auxiliary line in a side by side position comprises providing the auxiliary line with an interior containing an electric wire for transmitting electricity.

6. The method according to claim 1, wherein:

the step of wrapping a metal strip helically around the auxiliary line comprises providing the strip of the outer armor with a width that is greater than the width of the strip of the inner armor.

7. The method according to claim 1, wherein:

the step of wrapping a metal strip helically around the auxiliary line comprises providing the strip of the outer armor with a thickness that is greater than the thickness of the strip of the inner armor.

8. The method according to claim 1, wherein:

the step of wrapping a metal strip helically around the auxiliary line comprises providing a different metal for the strip of the outer armor than the metal used for the strip of the inner armor.

9. The method according to claim 1 wherein the step of placing at least one auxiliary line in a side by side position comprises placing two of the auxiliary lines in a side by side position, one located on each side of the inner armor.

10. A method of forming a cable for an electrical submersible pump, comprising:

placing three insulated power conductors adjacent each other to form an assembly of power conductors; then wrapping a metal strip helically around the assembly of power conductors to hold the power conductors adjacent each other and provide an inner armor; then placing at least one auxiliary line in contact with an exterior side of the inner armor; and wrapping a metal strip helically around the auxiliary line and over the inner armor to form a cable for an electrical submersible pump, with the metal strip wrapped around the auxiliary line securing the auxiliary line to the inner armor and defining an outer armor.

11. The method according to claim 10, wherein:

the step of placing three insulated power conductor adjacent each other comprises providing each of the power conductors with the same outer diameter; and the step of placing at least one auxiliary line in contact with an exterior side comprises providing the auxiliary line with an outer diameter that differs from the outer diameter of the power conductors.

12. The method according to claim 10, wherein:

the step of placing three insulated power conductor adjacent each other comprises providing each of the power conductors with the same outer diameter; and the step of placing at least one auxiliary line in contact with an exterior side comprises providing the auxiliary line with an outer diameter that is less than the outer diameter of the power conductors.

13. The method according to claim 10, wherein:

the step of placing at least one auxiliary line in contact with an exterior side comprises providing the auxiliary line with a hollow tubular interior for passing fluids.

14. The method according to claim 10, wherein:

the step of placing at least one auxiliary line in contact with an exterior side comprises providing the auxiliary line with an interior containing an electric wire for transmitting electricity.

15. The method according to claim 10, wherein:

the step of wrapping a metal strip helically around the auxiliary line comprises providing the strip of the outer armor with a width that is greater than the width of the strip of the inner armor.

16. The method according to claim 10, wherein:

the step of wrapping a metal strip helically around the auxiliary line comprises providing the strip of the outer armor with a thickness that is greater than the thickness of the strip of the inner armor.

17. The method according to claim 10, wherein:

the step of wrapping a metal strip helically around the auxiliary line comprises providing a different metal for the strip of the outer armor than the metal for the strip of the inner armor.

18. A method of forming a cable for an electrical submersible pump, comprising:

assembling three insulated power conductors of the same outer diameter adjacent and in contact with each other to form an assembly of power conductors; then wrapping a metal strip helically around the assembly of power conductors to hold the power conductors in contact with each other and provide an inner armor; then placing at least one auxiliary line in contact with an exterior side of the inner armor; and wrapping a metal strip helically around the auxiliary line and over the inner armor to secure the auxiliary line to the inner armor to define an outer armor and to provide a cable for an electrical submersible pump.

* * * * *